United States Patent [19]

Loser et al.

[11] Patent Number: 4,982,513

[45] Date of Patent: Jan. 8, 1991

[54] PROCESS AND DRYER SECTION FOR DRYING A RUNNING WEB IN A PAPER OR BOARD MAKING MACHINE

[75] Inventors: Hans Loser, Langenau; Tri Chau-Huu; Albrecht Meinecke, both of Heidenheim, all of Fed. Rep. of Germany

[73] Assignee: J. M. Voith GmbH, Fed. Rep. of Germany

[21] Appl. No.: 398,053

[22] Filed: Aug. 24, 1989

Related U.S. Application Data

[63] Continuation-in-part of Ser. No. 213,094, Jun. 29, 1988, Pat. No. 4,882,855.

[30] Foreign Application Priority Data

Jul. 1, 1987 [DE] Fed. Rep. of Germany ..... 3721734

[51] Int. Cl.[5] ..... F26B 13/08

[52] U.S. Cl. ..... 34/116; 34/113; 34/31; 34/111

[58] Field of Search ..... 34/110, 111, 113, 115, 34/116, 117, 152, 161, 23, 30, 31

[56] References Cited

U.S. PATENT DOCUMENTS 3,981,084 9/1976 Sobota ..... 34/152 X
4,183,148 1/1980 Koski ..... 34/116
4,882,855 11/1989 Loser et al. .

FOREIGN PATENT DOCUMENTS

WO88/04206 6/1988 PCT Int'l Appl. .

*Primary Examiner*—Albert J. Makay
*Assistant Examiner*—John Sollecito
*Attorney, Agent, or Firm*—Ostrolenk, Faber, Gerb & Soffen

[57] ABSTRACT

A dryer section of a paper or board making machine has a plurality of dryers. In a first group of dryers, each dryer heats the web somewhat more, but not to the level of the maximum evaporation rate of the moisture contained in the web. As the web is passing the end of the first group, the web is heated to such a high temperature that it reaches the maximum evaporation rate of the moisture in the web. The dryers in the first group have smaller diameters, which may gradually increase up to the region of the maximum evaporation rate, or they may all be of one smaller size. The dryer section has a second group of dryers in which each dryer heats the web to the maximum evaporation rate of the moisture contained in the web. The dryer at the beginning of the second group has the largest diameter. The following dryers in that group can have a smaller diameter. The dryers in the second group may be grouped in groups of decreasing size, or may gradually decrease in size. Advantageously, each group of dryers (A,B) is divided into subgroups ($A_1$; $A_2$; $B_1$; $B_2$; $B_3$; $B_4$) wherein first, one side of the web contacts all the dryers of one subgroup (for example $A_1$), and then the other side of the web contacts all the dryers in the next subgroup (for example $A_2$), and each subgroup is associated with one and only one fabric belt such as a felt or wire.

19 Claims, 3 Drawing Sheets

W $a_1$
$WP_a$
$b_1$
$WP_b$
F
$c_1$
$WP_c$
t
$t_c$
$t_b$
$t_a$

V $V_{max_a}$
$V_{max_b}$
F
$a_2$
$b_2$
$V_{max_c}$
$c_2$
t
$D_c$
$D_b$
$D_a$

Fig. 3
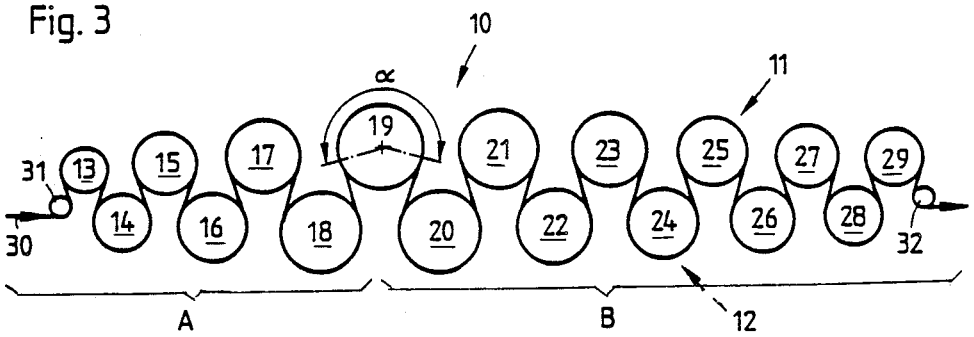
Fig. 4
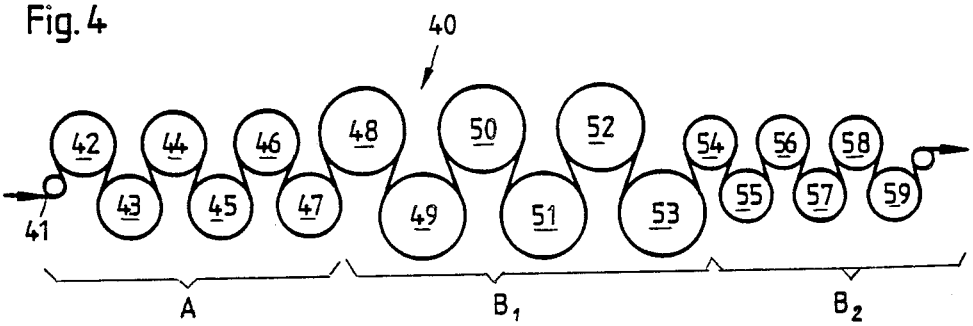
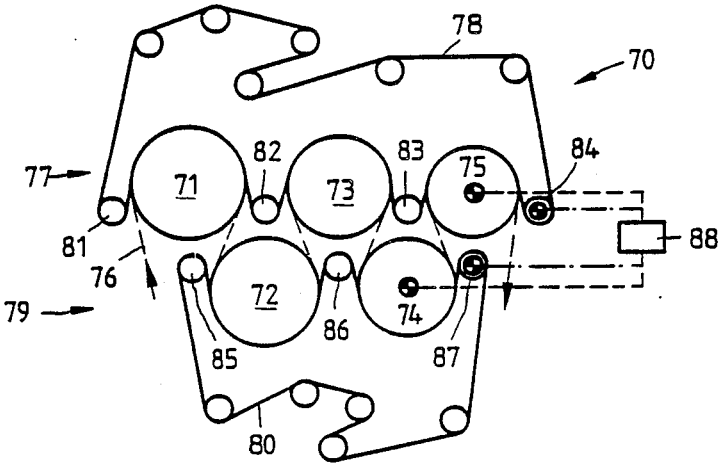
Fig. 5

PROCESS AND DRYER SECTION FOR DRYING A RUNNING WEB IN A PAPER OR BOARD MAKING MACHINE

CROSS-REFERENCE TO RELATED APPLICATION

This is a continuation-in-part of U.S. Patent Application Ser. No. 07/213,094 filed June 29, 1988, now U.S. Pat. No. 4,882,855.

BACKGROUND OF THE INVENTION

1. Field of the Invention

The invention concerns a dryer section for drying a running web in a multi-cylinder dryer section of a paper making or board making machine It also concerns a process for drying such a web.

2. Related Publications

Modern, high-speed paper making or board making machines have a dryer section, e.g. in accordance with DE-PS 27 30 149, which is equivalent to U.S. Pat. No. 4,183,148. This includes a large number of web dryers, in the form of cylindrical drums of equal diameter, generally either 1.25 m, or 1.5 m or 1.8 m. The dryers are arranged in two rows, one above the other. The web moves over the dryers in series alternating from one row to the other. The dryers are each heated with steam. The first dryers in the series are used to heat up the wet web. They have a lower surface temperature than the succeeding dryers in the series. The temperatures of the dryers usually rise gradually in the direction of web travel. The dryer drive system is combined into groups. The web is guided so as to meander alternately from row to row through the dryer section. In the process, the running web wraps the dryers with approximately the same centri-angle.

FIG. 9 of U.S. Pat. No. 3,868,780, issued Mar. 4, 1975; and FIG. 4 of PCT International Application WO 88/06204, published Aug. 25, 1988, also disclose drying sections wherein the dryer cylinders are grouped into groups. Both of these disclosures show groups of drying cylinders of equal size.

SUMMARY OF THE INVENTION

Measurements on moist paper webs to be dried on one rotating, heated dryer have shown that the quantity of water evaporated per $m^2$ (square meter) of paper during the web contact time on the dryer develops as illustrated in FIG. 1 of the drawings hereof in the curves $a_1$, $b_1$ and $c_1$. The "web-contact time" in one dryer is the time taken by a certain point on the web to travel from the approach point to the departure point of the dryer. In FIG. 1, the contact time t is plotted on the abscissa, and the quantity W of water evaporated per $m^2$ is plotted on the ordinate. The surface temperature of the dryer is constant. The three curves $a_1$, $b_1$ and $c_1$ in FIG. 1 show, from bottom to top, respective lower, middle range and higher paper moistness F at the point where the web begins to contact said one dryer.

It can be seen from the shape of the curves that they run through a turning point WP in which the evaporation rate (that is, the evaporated quantity of water per unit of area and unit of time) of the moisture contained in the web has its maximum value. This insight is new. After the region of the time axis or abscissa corresponding to the maximum evaporation rate, the evaporation rate decreases when the web contacts the dryer for a longer time. It can also be seen that at higher paper moisture (curve $a_1$), the region of the maximum evaporation rate is reached after a longer contact time $t_a$ than at a lower paper moisture (compare curves $b_1$ and $c_1$). In other words, the approach point must be farther from the departure point when the paper has a higher moisture content than when it has a lower moisture content.

This representation in the curves in FIG. 1 reflects solely its qualitative shape. A quantitative determination of the evaporation of the moisture contained in the web is dependent upon, among other things, the value of the paper moisture, i.e. the percentage of water content, the paper grade and the basis weight, the temperature of the dryer and the contact time of the web on the dryer. The contact time, in turn, depends upon the machine speed, the dryer diameter and the centri-angle of the web wrap on the dryer. The same applies to the drying of board webs.

The curves of the evaporation rate plotted over time can be derived from FIG. 1, that is, the rate curves are the respective derivatives of the quantity curves of FIG. 1. This results in the curves shown in FIG. 2. In these, the contact time t is plotted on the abscissa to the same scale as in FIG. 1, and the evaporation rate V is plotted on the ordinate. Curve $a_2$ is the higher paper moisture, curve $b_2$ and curve $c_2$ are each allocated lower paper moisture in accordance with FIG. 1. From the qualitative shape of the curves in FIG. 2, and provided the dryer temperatures are equal, it can be seen that the region of the maximum evaporation rate (at $WP_a$) is reached after a longer contact time with the moister paper web on a dryer than with the web of lower moisture content Again, on the assumption of a constant machine speed and equal centri-angle of the web wrap, it follows that to achieve the maximum evaporation rate $V_{max}$ over time while the web is running around the corresponding dryer, the moister web must be led around a dryer of larger diameter than the dryer about which a less moist web must be led. To the respective contact time indicated on the abscissa of FIG. 1, for achievement of the maximum value of the evaporation rate $V_{max}$ is therefore allocated the required corresponding dryer diameter D.

Since, as mentioned above, the dryers on modern, high speed paper or board making machines are of equal diameter, but the web moisture content decreases in the direction of web travel, the dryer section has thus far not been designed accordingly because of the lack of insights about the maximum evaporation rate. In addition, at the dryer diameters and machine speed used, the region of the maximum evaporation rate is not attained at least through major areas of the dryer section.

The invention therefore has the object of creating a process for the drying of a running web with which a higher rate of drying can be achieved in the dryer section. Another object is to create a paper or board making machine suitable for performing the process.

The process according to the invention uses a multi-cylinder dryer section, comprising a first group and a second group of dryers. The web is initially heated in the initial part (first group) of the dryer section which comprises a plurality of dryers. The web is gradually and increasingly heated as it moves from dryer to dryer in that initial part. Following the initial heating of the web in the initial part, at a first dryer of the second group, located past the initial part, the web is heated sufficiently to reach on this first dryer the maximum evaporation rate of the moisture contained in the web.

There are further dryers in series following said first dryer, at which the web for the first time reached the region of the maximum evaporation rate of moisture in the web. Between these successive dryers, the web cools slightly, but is held in contact with each successive dryer until it is again heated to again reach at least the region of the maximum evaporation rate of the moisture contained in the web.

After each heating to the maximum evaporation rate of moisture in the web, there is less remaining moisture in the web. It requires less heat therefore to again reach the maximum rate of evaporation, and a successively shorter contact time of the web with successive dryers will be needed to attain that evaporation rate. Note the changes in the turning point WP in FIG. 1 and $V_{max}$ in FIG. 2 as moisture content decreases.

The invention is advantageous particularly because through the attainment of the maximum evaporation rate on each of a number of dryers, the total contact time required for drying the web is shortened. This shortening is achieved by the more intensive drying of the web, because account is taken of the properties of the web, which vary during the course of the drying process from dryer to dryer, and especially the evaporation rate of the web which is dependent upon the web moisture at each dryer in series and upon the dryer temperature.

A paper or board making machine according to the invention has a series of dryers arranged in the path of web travel. For convenience, the dryers may be arranged in two rows. The web is wrapped around each of the dryers in series, at least approximately over the same centri-angle around the dryers This is readily accomplished when the dryers are arranged in two rows and the web is led from a dryer in one row to the dryer in the alternate row, with each dryer in one row being arranged between two dryers in the other row.

Along the path of web travel, the dryers in series have surface temperatures which rise in the direction of web travel. Following the heating up of the web as it moves over the first group of dryers in the initial part of the dryer section, the web reaches the second group of dryers and attains the region of the maximum evaporation rate of moisture contained in the web. The dryer or the series of dryers at the beginning of that region has the largest cross-section, that is, the largest diameter. In the group of dryers following the start of the region of the maximum evaporation rate and starting from the largest cross-section or diameter dryer, the dryers have a gradually decreasing cross-section or diameter in series in the direction of web travel. Yet, all of the successively smaller cross-section dryers still heat the web to the maximum evaporation rate for moisture in the web because of the gradually diminishing moisture content of the web.

A particular advantage of dimensioning of the dryers according to the invention lies in the design of the dryer section as a shorter machine section equipped with fewer dryers than has been the case up to now. This results in a reduction of the number of dryers used for web drying, in comparison with dryer sections having dryers that are all of the same diameter, e.g. in accordance with DE-OS 27 30 149. A smaller number of dryers also means fewer open web draws during the web run from dryer to dryer, and thus also means a reduced risk of web breaks, which cause a major disturbance in the production process.

The dryers arranged at the initial part or entrance part or region of the dryer section heat up the web as it moves towards the region where for the first time the maximum evaporation rate can be reached on one dryer Those dryers in that initial part are smaller in cross-section or diameter than the first of the dryers in the region of maximum evaporation rate of moisture. Those dryers in the initial part of the dryer section may gradually increase in size, from the dryer where the web enters the first dryer section, up to the first dryer at which the maximum evaporation rate is reached. The capacity of the dryer section is optimized by dryers adapted to the curve of favorable moisture evaporation recognized according to the invention. In some embodiments of the invention, the initial group of dryers in the initial part may all have the same cross-section or diameter or they may gradually increase in cross-section or diameter in the direction of web travel. This serves to protect the web, as extending the warming-up over several dryers influences the web quality, and especially the surface structure of the web before the web travels into the region in which the maximum evaporation rate is reached at each dryer.

The dryers following said first dryer may gradually decrease in diameter. Or, they may be arranged in differently dimensioned groups with a first group of larger diameter and a second group of smaller diameter (further in the direction of web travel from the first group), and all dryers in each of those groups being of the same diameters, respectively. In the latter case, manufacturing economies are taken into account, as several dryers of equal diameter can be manufactured more economically than a number of dryers of gradually decreasing diameter.

In a particularly advantageous embodiment, the dryers in the first group and the second group are divided into subgroups, each subgroup including dryers having the same diameter. The successive subgroups may be placed alternately in top and bottom rows of dryers, or may be oriented in other ways, such as in parallel rows which are all, for example, diagonal with respect to a central plane of the drying section and the overall web travel direction. As the web travels in the travel direction, first, one side of the web contacts all the dryers of a given subgroup; and then, the other side of the web contacts all the dryers in the next subgroup.

At least one endless belt of fabric, such as a wire or felt, may be used to support the web during its run around at least some of the dryers, such as the dryers in one row, or one subgroup The fabric belt is disposed on the outside of the web moving over the dryers so that the web is sandwiched between the fabric belt and the dryer cylinders. At least one of the dryers or at least one of the rolls carrying the fabric belt is driven, in order to move the fabric belt, which in turn moves the supported web which also moves the dryer cylinders to rotate. With this further development of the invention, equal peripheral speeds of the dryers are obtained by simple means, so that sophisticated gears required for mechanical coupling of the dryers or extensive motor control equipment required for individual dryer drive may be dispensed with. A drive of free-running mounted dryers of equal diameter by motor-driven fabric rolls is known from DE-OS 33 22 996, which corresponds to U.S. Pat. No. 4,495,711.

Embodiments of the invention are explained below with reference to the drawings.

BRIEF DESCRIPTION OF THE DRAWINGS

FIG. 3 is a schematic representation of a first embodiment of the dryer section of a paper or board making machine with dryers initially increasing in diameter in the direction of web travel up to a first dryer at which the maximum evaporation rate of water from the web is reached and with dryers decreasing in diameter further through the dryer section, after said first dryer;

FIG. 4 is a schematic representation of a second embodiment of a dryer section, with dryers graduated in groups according to diameter;

FIG. 5 is a schematic representation of a third embodiment of a dryer section, with dryers driven by fabrics or felts.

DESCRIPTION OF THE PREFERRED EMBODIMENTS

Figure 1:
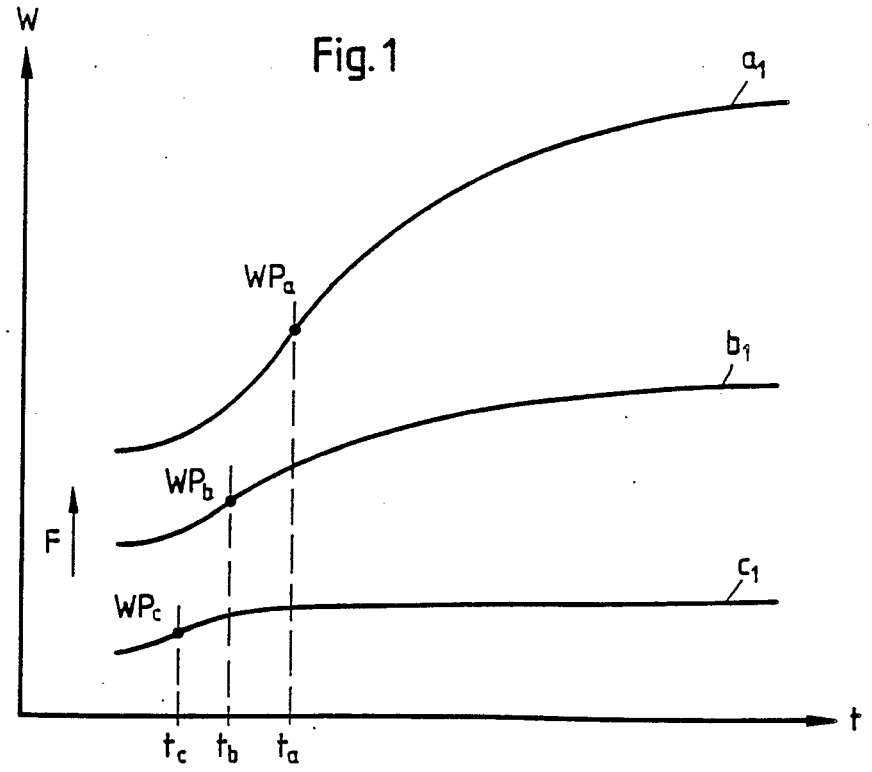
FIG. 1 illustrates three curves plotting contact time of a web to be dried on a dryer with the evaporated quantity of water per unit area, with a constant dryer surface temperature.
Figure 2:
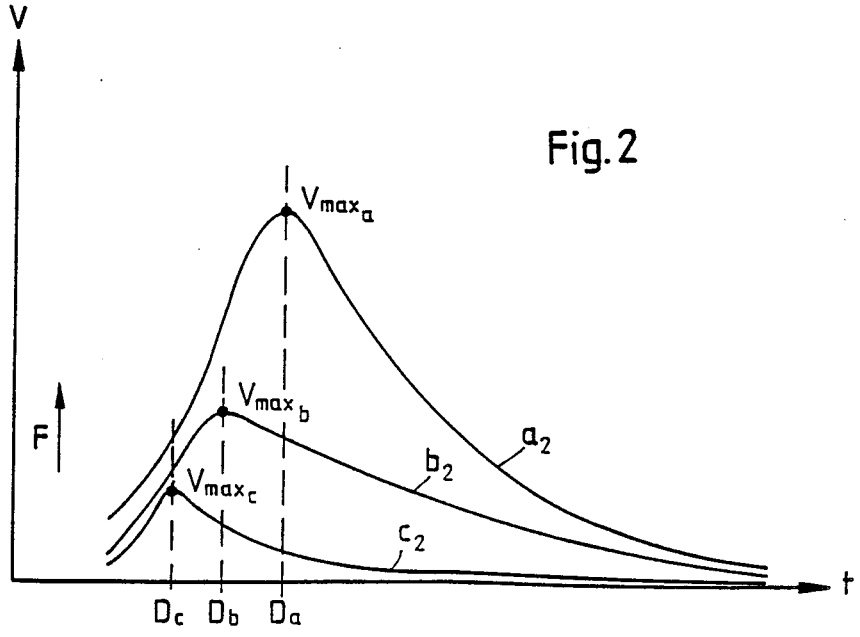
FIG. 2 plots the contact time against the evaporation rate, the time derivative of FIG. 1.

FIGS. 1 and 2 have been discussed as part of the background of the invention.

The multi-dryer section 10 shown as the first embodiment in FIG. 3 is a part of a paper or board making machine, not shown, that operates with a fixed production or web motion speed The dryer section 10 comprises rotatable drum dryers 13 to 29, arranged in two parallel rows 11 and 12 one above the other. The dryers are staggered in their arrangement so that a dryer in each row is between two dryers in the other row. Around these dryers meanders a web 30 (from left to right in direction of travel in FIG. 3) from row to row. Because of the arrangement and placement and proximities of the dryers 13 to 29 as well as of the end-side rolls 31 and 32, the web 30 wraps the individual dryers with approximately the same centri-angle $\alpha$.

Dryers 13 to 29 of the dryer section 10 are heated so that the individual dryers in the meandering sequence of web travel have gradually rising surface temperatures in the direction of web travel. The dryers 13 to 18 in the initial part A of the dryer section 10 have gradually increasing diameters in the direction of web travel. The duration of the contact of the web 30 with the peripheral surface of each of these dryers 13 to 18 therefore increases in the direction of web travel. Starting from the largest diameter dryer 19 of the dryer section, the dryers 19 to 29 arranged in the succeeding part B of the dryer section 10, on the other hand, have gradually decreasing diameters in the direction of web travel.

In the initial part A of the dryer section 10, the moist web coming from a press section, not shown, of the paper and board making machine is heated. The heating of the web 30 is done gently, as, on the one hand, the surface temperatures of the dryers 13 to 18 gradually increase and, on the other hand, the contact time of the web on the individual dryers extends in numerous increasing steps in the direction of web travel due to the increasing diameters.

Following the heating of the web 30, it is not until the web enters part B of the dryer section 10 that at each dryer the maximum evaporation rate of the moisture contained in the web is reached. After traveling around the first dryer 19 at which the maximum evaporation rate of moisture in the web is reached, the web 30 runs with successively reduced moisture content to the next dryer 20, and so on over dryers 21 to 29. Moving from dryer to dryer, the web cools slightly. At each dryer 20 to 29, the web is again heated to its then maximum evaporation rate for the moisture then remaining in the web. At each dryer in sequence the maximum evaporation rate is reached earlier than before (see FIG. 2) due to the decrease in the moisture remaining in the web. Furthermore, each dryer 20 to 29 in sequence may have a higher surface temperature. This makes necessary an increasingly shorter contact time between the web and each successive dryer to achieve at each dryer the region of the maximum evaporation rate This has been taken into account in the present embodiment by the gradual diminution in the dryer diameters in the direction of web travel. After the wrap of the last dryer 29 of the dryer section 10, the web 30 should have reached its desired dryness.

The absolute value of the number of dryers in the dryer section for heating and drying of the web, the diameter of the individual dryers, their surface temperature, the centri-angle of the web wrap, etc., are primarily dependent on the basis weight of the web to be dried, its dewaterability, which is dependent upon the grade of stock, and the machine speed. It is therefore mainly the last mentioned criteria which dictate the dimensions of the dryer section in which the region of the maximum evaporation rate of the moisture contained in the web is reached following the heating of the web.

For the following reason, a dryer section optimized with regard to the drying of the web largely retains its favorable characteristic even upon a desired basis weight change of the web to be dried. For example, as a rule, a more unfavorable drying behavior of the web is also associated with a higher basis weight. That requires a longer contact time to reach the region of the maximum evaporation rate. At the same time, however, a higher basis weight of the web requires a reduction of the production speed. The consequently extended web contact time on he respective dryer thus compensates for its more unfavorable drying behavior.

Furthermore, a fabric used to support the web during its run around the dryers has a considerable influence on the dimensioning of the dryers, especially when the fabric, as shown in German Patent No. 27 30 149, wraps the dryers of both rows and not only the dryers of one row. In the embodiment of the dryer section in that patent, the moist web contacts the dryers of one row directly, but contacts the dryers of the other row with the fabric sandwiched between the web and the dryers. In order to reach the region of the maximum evaporation rate, the dryers of the last mentioned fabric covered row must therefore either be run at higher temperature because of the impairment of the heat transfer caused by the fabric, or must be designed to be larger in diameter than when there is no supporting fabric.

Referring again to FIG. 3, at each of the dryers 19 to 29 there is an "approach point" where the web to be dried comes into contact with the dryer, and a "departure point" where the web leaves the dryer. According to an important aspect of the invention, at each of these dryers 19–29, the maximum evaporation rate should be reached approximately at the "departure point." In other words, the diameter and temperature of each dryer, the machine speed, etc., are selected such that on each of the dryers 19–29 the maximum evaporation rate is reached as close as possible to the departure point. This object can be achieved rather precisely with dryers gradually decreasing in diameter as in FIG. 3, while the dryer arrangements of FIGS. 4 and 6 can achieve it somewhat less precisely.

The second embodiment of a dryer section 40 of the invention shown in FIG. 4 is divided into one initial part A for heating up the web 41 and into a part B in which the region of the maximum evaporation rate of the moisture contained in the web is reached at each dryer For manufacturing and economy reasons, dryers 42 to 47 of the initial part have the same diameters. For the same reason, dryers 48 to 59 of part B are divided into two groups $B_1$ and $B_2$, each having dryers of the same respective diameter. Dryers 48 to 53 of Group $B_1$ have a relatively larger diameter, whereas dryers 54 to 59 of Group $B_2$ have a smaller diameter, as the reduced moisture content of the web when moving through this part of the dryer section 40 requires a shorter contact time between the web and a dryer to reach the region of the maximum evaporation rate than in Group $B_1$.

As an example for the dimensioning of the dryer section 40 according to the invention, the following is a comparison with a traditional dryer section of a paper making machine for LWC (light weight coated) paper with a basis weight of 40 g/m$^2$ and a production speed of 1050 m/min: The machine has 54 dryers with identical diameters of 1.8 m. The dryers, numbered consecutively in the direction of web travel, have the following surface temperatures:

Dryers 1 to 15: 60° to 80° C.,
Dryers 16 to 31: 80° to 90° C.,
Dryers 32 to 54: 90° to 110° C.

On the other hand, a dryer section designed in conformity with the invention for the drying of the same web at the same machine speed has the following features:

Dryers 1 to 12: diameter 1.8 m, surface temperature 60° to 80° C.,
Dryers 13 to 27: diameter 2.9 m, surface temperature 80° to 90° C.,
Dryers 28 to 43: diameter 1.5 m, surface temperature 90° to 110° C.

This results in a reduction of the number of dryers by 11 dryers. The dryer section can therefore be built at a lower cost than a traditional type despite using 15 dryers of larger diameter.

In the further embodiment represented in FIG. 5, a dryer group 70 is comprised of five dryers 71 to 75 which are successively reduced in diameter in the direction of web travel 76 (from left to right in the drawing). The dryers 71, 73 and 75 forming the top row 77 have a fabric belt 78, such as a paper making machine wire or a felt, only on the outside of the web, to support the web 76 during its run around the dryers. A fabric belt 80 is also provided for the dryers 72 and 74 of the bottom row 79 and again the fabric 80 is only outside the web. The fabrics 78, 80 are led with the aid of rolls 81 to 87, rolls 81 to 84 for the top fabric 78, and rolls 85 to 87 for the bottom fabric 80, around almost half the external peripheries of dryers 71 to 75 outside the webs.

Dryers 71 to 75 of Group 70 are driven by dryer 75 of the top row 77 as well as by dryer 74 of the bottom row 79. The two dryers 74 and 75 coupled with conventional drive motors, not shown, are synchronized by a control unit 88 in a control ratio dependent upon their diameter (broken line in FIG. 5) to achieve the same peripheral speed. The fabrics 78 and 80 allocated to the respective rows 77 and 79 transmits the drive torque acting at dryers 74 or 75 as tensile force to the other fabric-wrapped dryers 71 and 73 or 72, which are mounted to run free. Deviating from this, dryers 71 to 75 of Group 70 can also be driven in the same way by fabric support rolls 84 or 87 coupled with drive motors, not shown. Rolls 84 and 87 are then also synchronized by the control unit 88 (chain lines in FIG. 5), while all dryers 71 to 75 would then be mounted to run free.

Figure 6:
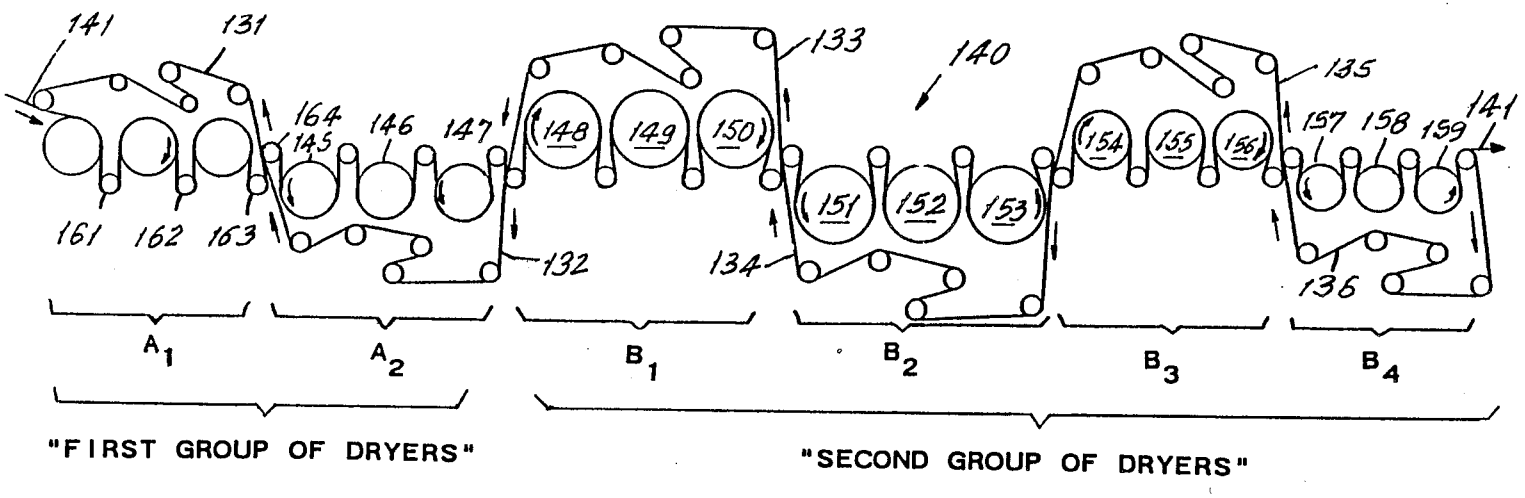
FIG. 6 is a schematic representation of a fourth embodiment of a dryer section, wherein the groups of dryers are arranged in subgroups.

The dryer section 140 shown in FIG. 6 has the same number of drying cylinders as that shown in FIG. 4, but there are several differences At least the second group of dryers, and preferably both the first and second groups of dryers (A,B), are each divided into respective subgroups $A_1$; $A_2$; $B_1$; $B_2$; $B_3$; $B_4$. For example, the first group of dryers A is divided into a subgroup $A_1$ consisting of dryers 142–144 and a subgroup $A_2$ consisting of dryers 145–147. The dryers 142–144 form one row while the dryers 145–147 form another row. In the embodiment these two rows are upper and lower rows, on opposite sides of a central plane of the dryer section, but other arrangements are possible In this embodiment, the "first group of dryers" comprises subgroups $A_1$ and $A_2$. The diameter of cylinders 142 to 147 in FIG. 6 is relatively small, although that is not essential to the invention, and it could be as great as that of cylinders 148 to 153. The "second group of dryers" comprises subgroups $B_1$ through $B_4$. The diameter of the cylinders in subgroup $B_3$ is smaller in this example than that of the cylinders in subgroups $B_1$ and $B_2$. The diameter of the cylinders in subgroup $B_4$ is again slightly smaller than that of the cylinders in subgroup $B_3$.

In the embodiments of FIGS. 4 and 5, an upper endless belt (felt or wire) is associated with the upper row of cylinders, while a lower endless belt is associated with the lower row of cylinders. The web, supported by these two belts, meanders alternately from the upper row to the lower row and back again The web travels free, unsupported by a belt, from one cylinder to the next.

In contrast, in the embodiment of FIG. 6, the web 141 travels through the entire dry end supported by only one belt at a time. In FIG. 6 there are six belts 131–136 each associated with a respective one of the dryer subgroups. In subgroup A, for example, the belt 131 meanders together with web 141 around dryer 142 to guide roll 161, around dryer 143 to guide roll 162, and finally around dryer 144 to guide roll 163. Then it is transferred from the first belt 131 to a second belt 132 at a point between the guide roll 163 and a next guide roll 164 which is associated with the second subgroup $A_2$.

In the first subgroup $A_1$ it is the bottom of web 141 that comes into contact with dryers 142–144. On the other hand, in the second subgroup $A_2$ it is the top of the web that comes into contact with the dryers 145–147. The changeover occurs between the exit guide roll (e.g., 163) of one subgroup and the entrance guide roll (e.g., 164) of the next. The guide rolls (e.g. 161–164) are preferably provided with suction systems to secure the web and belt to the guide roll.

In all the embodiments in FIGS. 1–6, there are at least as many dryers in the second group as in the first group; and the two sides of the web alternately come into contact with dryers. In addition, in the embodiment of FIG. 6, there is no longer a need to provide two belts at every region along the entire length of the dry end. It is only necessary to provide one respective belt, associated with each subgroup of dryers, for guiding the web, since at that region of that particular subgroup of dryers, only one side of the web contacts the dryers.

In the foregoing, the present invention has been described in connection with several embodiments thereof. Since many variations and modifications of the present invention will become apparent to those skilled in the art, the scope of this invention is to be determined not by the specific disclosures herein but only by the appended claims.

What is claimed is:

1. A dryer section of a paper or board making machine, the dryer section comprising:

a series of heated dryers, disposed such that a web to be dried having two sides can be wrapped at least partially around each of the dryers in series, such that the web is heated by each dryer as it moves along the series of dryers;

said series of dryers comprising a first group of dryers having means to heat up the web after entering the dryer section to a level which is below a level of maximum evaporation rate;

a second group of dryers, following said first group of dryers, with each dryer of that second group having means to heat the web at least to the level of maximum evaporation rate;

at least said second group of dryers including a plurality of subgroups of dryers, and each subgroup having a plurality of dryers;

said second group including a first subgroup of dryers which is positioned substantially where the web enters the second group, and a series of subgroups of dryers in series thereafter in the direction of web travel; at least some of the subgroups of dryers in series after said first subgroup having a smaller diameter than the dryers of said first subgroup;

the number of dryers of said second group being at least equal to the number of dryers of said first group; and at least said second group of dryers having means for guiding said web such that adjacent subgroups of dryers alternatingly contact opposite sides of the web.

2. The dryer section of claim 1, comprising means supporting the web for wrapping the web to define at least approximately the same centri-angle around each of the dryers.

3. The dryer section of claim 2, wherein succeeding subgroups of dryers are arranged in separate rows, and have means for guiding the web to wrap successively around the subgroups of dryers in their separate rows, and the means for wrapping the web around approximately the same centri-angle of the dryers comprises at least one guide roll between each two of said dryers.

4. The dryer section of claim 3, wherein at least some of said guide rolls include suction means for holding said web to said guide roll.

5. The dryer section of claim 3, wherein between each two subgroups of dryers are an exit guide roll of the first of said two subgroups and an entrance guide roll of the second subgroup.

6. The dryer section of claim 1, wherein all the dryers of each subgroup have the same diameter.

7. The dryer section of claim 1, wherein the dryers comprise means for having their respective surface temperatures rise along the series of dryers in the direction of web travel.

8. The dryer section of claim 7, wherein the second subgroup of dryers of the second group have substantially the same diameter as the dryers in the first subgroup, and at least some of the succeeding subgroups of dryers in series in the direction of web travel have a smaller diameter.

9. The dryer section of claim 8, wherein after the second subgroup of dryers in the region of maximum evaporation rate of moisture from the web, and further in the travel direction of the web which is still in the region of maximum evaporation rate of moisture from the web, the dryers form additional subgroups of dryers, all of which have a second smaller diameter.

10. The dryer section of claim 9, wherein the diameters of the dryers in the first group are smaller than said largest diameter of the first subgroup of dryers in the second group.

11. The dryer section of claim 10, wherein at least some of the dryers in the first group have the same diameter.

12. The dryer section of claim 11, wherein all the dryers of the first group have the same diameter.

13. The dryer section of claim 1, wherein the dryers in the first group are smaller in diameter than a dryer that is substantially at the beginning of the second group in the region of maximum evaporation rate of the web.

14. The dryer section of claim 13, wherein the dryers have means for causing their respective surface temperatures to rise along the series of dryers in the direction of web travel.

15. The dryer section of claim 1, further comprising a fabric belt wrapping around all the dryers of at least one of the subgroups of dryers and wrapping over the web at said subgroup, such that as the web passes over the dryers wrapped by the fabric belt, the web is wrapped on one side by the fabric belt and on the other side the web wraps the dryer.

16. The dryer section of claim 15, comprising a respective fabric belt wrapping over each of the subgroups of dryers and wrapping over the web at said respective subgroup, such that as the web passes over the dryers wrapped by the fabric belt, the web is wrapped on one side by the fabric belt and on the other side the web wraps the dryer.

17. The dryer section of claim 16, further comprising means for driving at least one fabric belt to move over its respective dryers.

18. The dryer section of claim 17, wherein the dryers over which the fabric belt moves are mounted to run free and are driven to rotate by the movement of the fabric belt.

19. The dryer of claim 18, wherein one of the rolls over which the fabric belt runs is driven and means are connected with that roll for drivinq that roll to rotate, and the driving of that roll moves the fabric belt over the dryers.

* * * * *